US011773573B1

(12) United States Patent
Ni et al.

(10) Patent No.: US 11,773,573 B1
(45) Date of Patent: Oct. 3, 2023

(54) ANTI-SLIP SHOWER SYSTEM

(71) Applicant: XIAMEN DELMEI SANITARY WARE CO., LTD., Xiamen (CN)

(72) Inventors: Changzheng Ni, Xiamen (CN); Yongqiang Yan, Fuzhou (CN); Chunhua Wang, Xiamen (CN)

(73) Assignee: XIAMEN DELMEI SANITARY WARE CO., LTD., Xiamen (CN)

( * ) Notice: Subject to any disclaimer, the term of this patent is extended or adjusted under 35 U.S.C. 154(b) by 0 days.

(21) Appl. No.: 17/990,671

(22) Filed: Nov. 19, 2022

(30) Foreign Application Priority Data

Sep. 30, 2022 (CN) ..... 202211215634.X

(51) Int. Cl.
*E03C 1/06* (2006.01)
*B05B 1/18* (2006.01)

(52) U.S. Cl.
CPC ..... *E03C 1/066* (2013.01); *B05B 1/185* (2013.01)

(58) Field of Classification Search
CPC ..... E03C 1/066
USPC ..... 4/615
See application file for complete search history.

(56) References Cited

U.S. PATENT DOCUMENTS 8,191,185 B2 * 6/2012 Tsai ..... E03C 1/06 4/615
2015/0265105 A1 * 9/2015 Zhou ..... B05B 1/1645 4/601

* cited by examiner

*Primary Examiner* — Lauren A Crane
(74) *Attorney, Agent, or Firm* — Daniel M. Cohn; Howard M. Cohn

(57) ABSTRACT

An anti-slip shower system includes a water passage assembly and a water outlet pipe assembly movably arranged on the water passage assembly. The water outlet pipe assembly includes an adjustment male part which can limit movement of the water outlet pipe assembly on the water passage assembly. The water passage assembly includes a water passage cavity and an insertion channel, the water passage cavity and the insertion channel are arranged at an interval, and a movement channel is arranged between the insertion channel and the water passage cavity. The movement channel is internally provided with a piston, when the piston and the adjustment male part are away from the water outlet pipe assembly, the water outlet pipe assembly is movable on the water passage assembly, when the piston and/or the adjustment male part presses against the water outlet pipe assembly, the water outlet pipe assembly is stably fixed.

10 Claims, 6 Drawing Sheets

ANTI-SLIP SHOWER SYSTEM

CROSS-REFERENCE TO RELATED APPLICATIONS

This application is based upon and claims priority to Chinese Patent Application No. 202211215634.X, filed on Sep. 30, 2022, the entire contents of which are incorporated herein by reference.

TECHNICAL FIELD

The present disclosure relates to the technical field of sanitary products, in particular to an anti-slip shower system.

BACKGROUND

For the sake of convenience, the water outlet pipe of known shower systems is generally adjustable and movable vertically to satisfy the requirement of users having different heights. After the water outlet pipe is adjusted to a suitable height, a securing structure is required to fix the water outlet pipe and make it unmovable. However, when the user fails to firmly fix the movable water outlet pipe after height adjustment, it is possible that the water outlet pipe slides downward under the driving effect of water pressure during use, resulting in impact on the user who is taking a shower.

SUMMARY

In order to solve the above problems, the present disclosure provides an anti-slip shower system.

To achieve the above objective, the present disclosure proposes the following technical solutions.

An anti-slip shower system includes a water passage assembly and a water outlet pipe assembly movably arranged on the water passage assembly. The water outlet pipe assembly includes an adjustment male part which can limit movement of the water outlet pipe assembly on the water passage assembly. The water passage assembly includes a water passage cavity and an insertion channel. The water passage cavity and the insertion channel are arranged at an interval, and a movement channel is arranged between the insertion channel and the water passage cavity. The movement channel is internally provided with a piston, when the piston and the adjustment male part are away from the water outlet pipe assembly, the water outlet pipe assembly is movable on the water passage assembly, when the piston and/or the adjustment male part approaches to press against the water outlet pipe assembly, the water outlet pipe assembly is stably fixed.

Preferably, the water passage cavity is internally provided with partition walls to divide the water passage cavity into a water inlet cavity, an accommodation cavity and at least two water outlet cavities that are spaced apart. The water inlet cavity, the accommodation cavity and the water outlet cavities are interconnected sequentially. The movement channel is provided with a water passage hole at a side close to the water passage cavity, and the water passage hole is interconnected with the accommodation cavity and/or the water outlet cavities.

Preferably, the water passage assembly includes a main body, the water passage cavity, the insertion channel, and the movement channel are all configured in the main body, and the main body has an water inlet and a plurality of water outlets. The water inlet and the water outlets are interconnected with the water passage cavity. The water inlet is connected with a water inlet joint, and the water outlets are connected with water outlet joints respectively.

Preferably, the anti-slip shower system further includes a switching assembly, the switching assembly is inserted and accommodated in the water passage cavity, and the switching assembly is interconnected with the water inlet joint. By operating the switching assembly to select or switch water passage, the water inlet joint is selectively connected to the plurality of water outlets.

Preferably, the water inlet cavity is interconnected with the water inlet joint, and each of the water outlet cavities is connected to one of the water outlet joints. The accommodation cavity is provided with a through opening at a side away from the water inlet cavity, and the switching assembly is inserted into and accommodated in the accommodation cavity from the through opening.

Preferably, there are two water outlet cavities, one of the water outlet cavities is connected with the water outlet pipe assembly through a first water outlet joint, and the other one of the water outlet cavities is connected to a hand shower through a second water outlet joint.

Preferably, the insertion channel is provided with an opening at a side away from the water passage cavity, the opening is provided with an adjustment female part, and the adjustment male part is movably connected with the adjustment female part to press against or move away from the water outlet pipe assembly.

Preferably, the water outlet pipe assembly includes an anti-slip component arranged in the insertion channel and a supportive pipe movably inserted into the anti-slip component. The adjustment male part is inserted into the opening to fasten or release the supportive pipe by pressing against or moving away from the anti-slip component.

Preferably, the piston includes a piston main body connected to the movement channel and a movable fastening element movably inserted in the piston main body, the movable fastening element movably presses against the supportive pipe to suppress movement of the supportive pipe.

Preferably, the piston main body has a recess and a through hole extending through the recess. The movable fastening element has a push rod and a restriction part. The restriction part is provided on the push rod at an end away from the piston main body. An outer circumferential wall of the restriction part is provided with a sealing groove which is concave inward. A spring is sleeved on the push rod, and the spring is limited between the restriction part and the recess.

The present disclosure has the following advantages.

1) A piston is arranged between the water passage assembly and the water outlet pipe assembly. Under the action of the water pressure from the water flow in the water passage assembly, the piston is pushed to approach and then tightly press against the water outlet pipe assembly, so as to provide an additional securing structure to avoid movement of the water outlet pipe assembly in the process of taking a shower.

2) The water passage assembly is internally provided with a water passage cavity and an insertion channel, and the movable water outlet pipe assembly is inserted through the insertion channel. A movement channel is provided between the insertion channel and the water passage cavity, so that the piston is movable in the movement channel to press against or move away from the water outlet pipe assembly. When water flows through, the piston is applied with water pressure to push against the water outlet pipe assembly. When there is no water flow, no water pressure is applied on the piston and the piston moves away from the water outlet pipe assembly, so as to allow adjustment of the height of the water outlet pipe assembly as desired.

3) The water passage cavity is provided with a water inlet cavity, an accommodation cavity and a plurality of water outlet cavities that are partitioned with each other and are interconnected in sequence. The water passage hole arranged on the movement channel is interconnected with the accommodation cavity or the water outlet cavity. By doing so, after operating the switching assembly in the accommodation cavity, no matter which water outlet cavity the water flow is switched to, the pressure of the water flow can always be applied on the piston to push the piston to press against the water outlet pipe assembly. Therefore, no matter the top shower mounted on the water outlet pipe assembly or the handheld shower is used by the user during the process of taking a shower, it can all be ensured that the movable water outlet pipe assembly is stably fastened.

BRIEF DESCRIPTION OF THE DRAWINGS

The accompanying drawings described below are used to facilitate understanding of the present disclosure and constitute a part of the present disclosure. The exemplary embodiments of the present disclosure and their descriptions are used to explain the present disclosure which cannot be regarded as improper restriction to the present disclosure.

REFERENCE NUMERALS IN THE DRAWINGS

Figure 1:
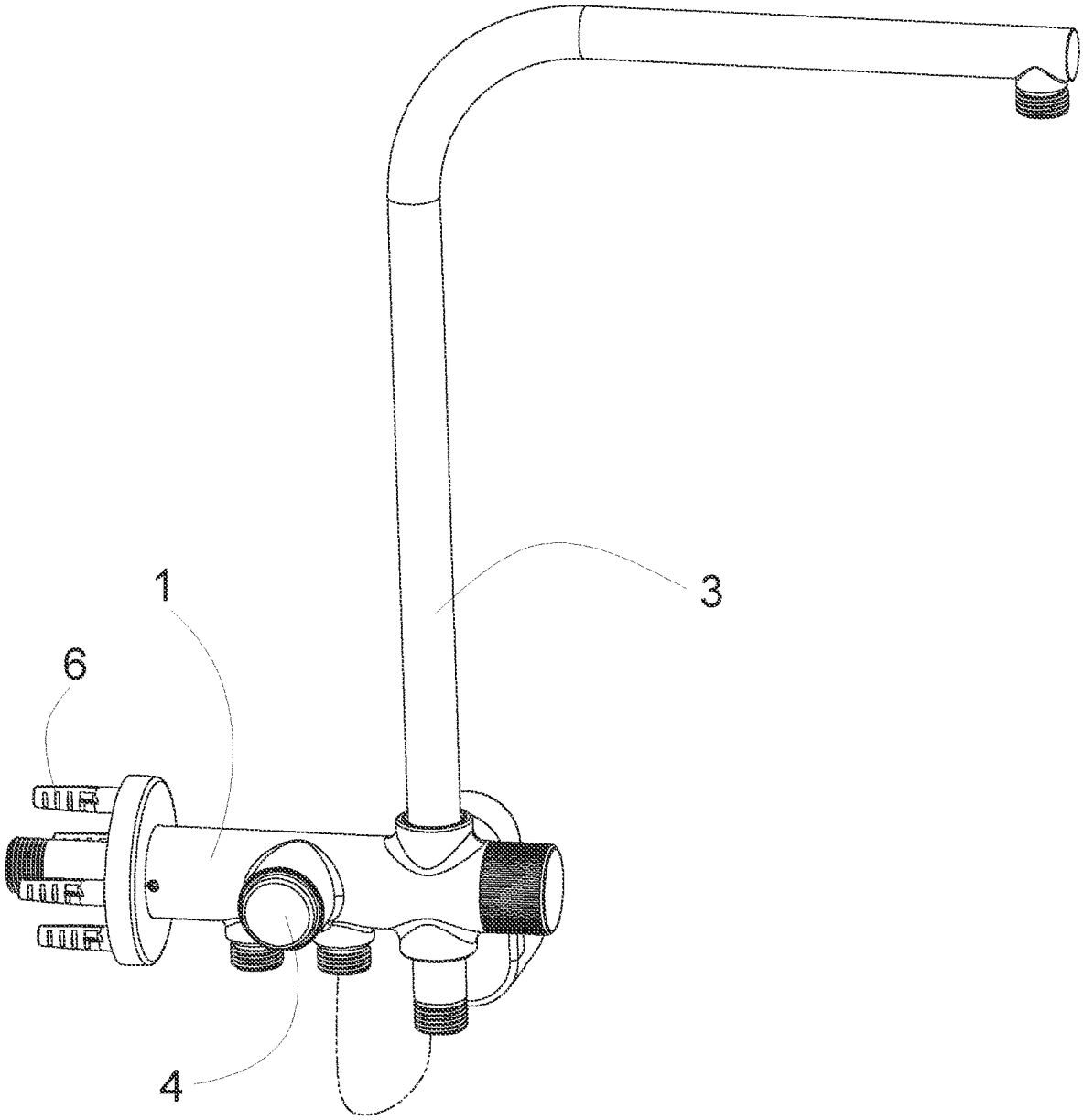
FIG. 1 is an axonometric view of an anti-slip shower system according to an embodiment of the present disclosure.
Figure 2:
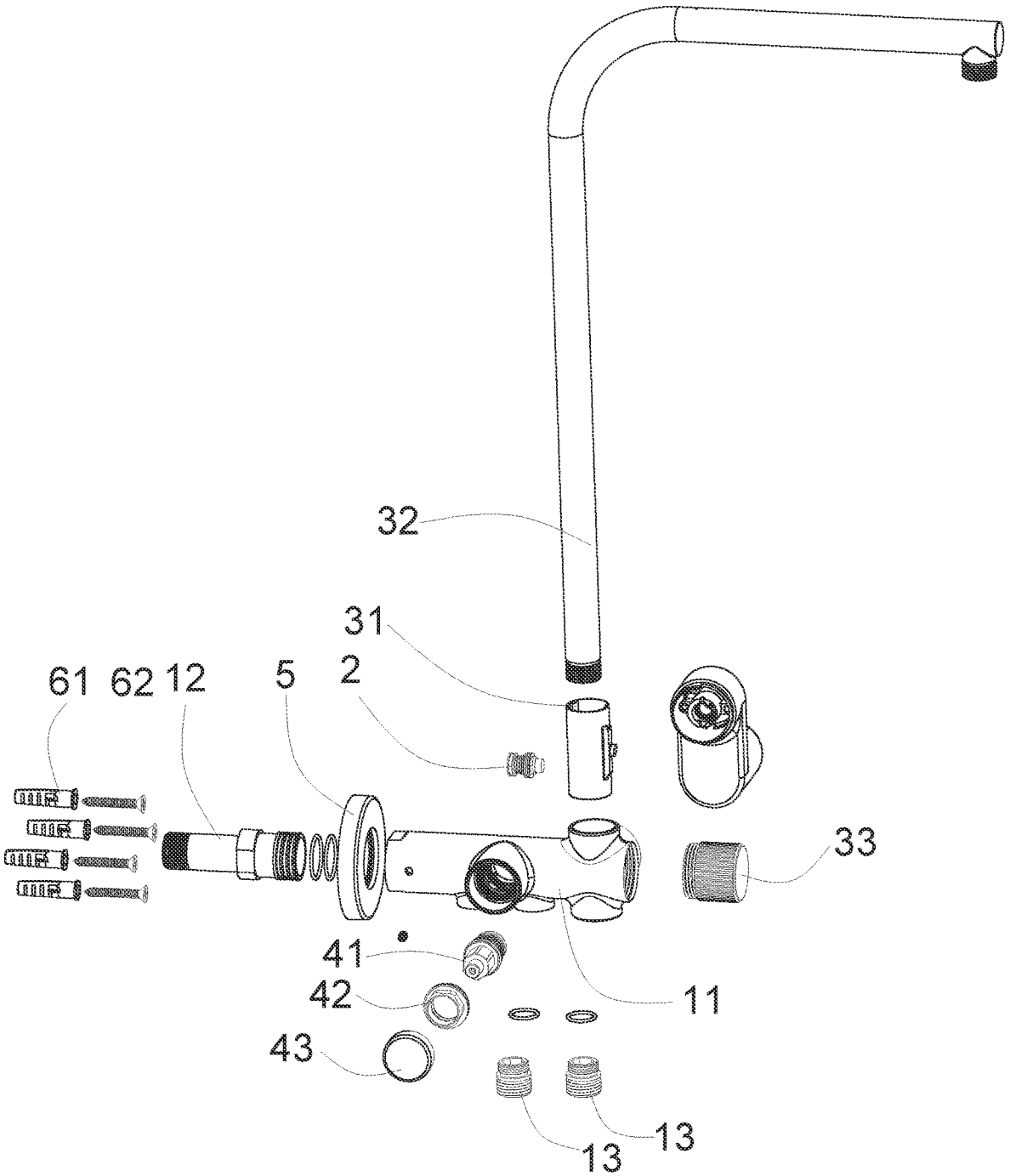
FIG. 2 is an exploded view of the anti-slip shower system of the present disclosure.
Figure 3:
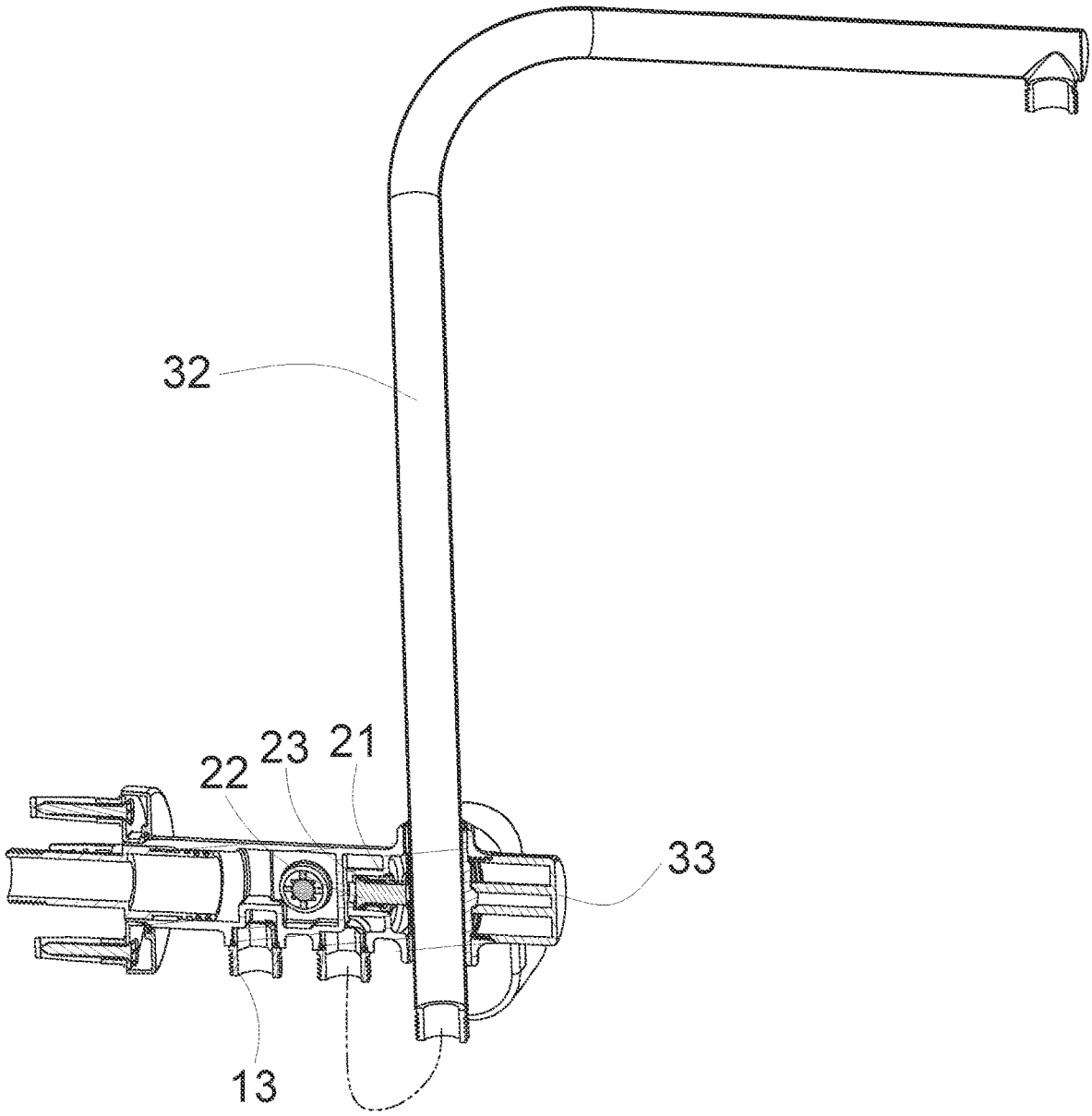
FIG. 3 is a first sectional view of the anti-slip shower system of the present disclosure.

1—water passage assembly; 11—main body; 111—accommodation cavity; 112—water passage hole; 113—water outlet cavity; 114—movement channel; 12—water inlet joint; 13—water outlet joint;

2—piston; 21—piston main body; 22—movable fastening element; 23—spring;

3—water outlet pipe assembly; 31—anti-slip component; 32—supportive pipe; 33—adjustment male part;

4—switching assembly; 41—switching cartridge; 42—fastening cover; 43—operation element;

5—decorative cover;

6—installation accessories; 61—sleeve; 62—screw.

DETAILED DESCRIPTION OF THE EMBODIMENTS

In order to clarify the technical problems, technical solutions and advantages of the present disclosure and make the present disclosure more comprehensible, the present disclosure will be further described in detail below with reference to the accompanying drawings and embodiments. It should be understood that the specific embodiments described herein are merely intended to explain the present disclosure rather than to limit the present disclosure.

Referring to FIGS. 1-7, a preferred embodiment of the present disclosure is provided. An anti-slip shower system includes a water passage assembly 1, a switching assembly 4 configured in the water passage assembly 1, and a water outlet pipe assembly 3 movably configured on the water passage assembly 4. The water flow enters the water passage assembly 1, then the water flow runs through the switching assembly 4 which can be operated to select water outlet passage, and the water flow selectively comes out from the water outlet pipe assembly 3 for use.

The water passage assembly 1 includes a main body 11. The main body 11 includes a water passage cavity, a water inlet, a plurality of water outlets, and an insertion channel. The water inlet and water outlets are interconnected with the water passage cavity. The water passage cavity and the insertion channel are arranged at an interval. The water inlet is connected to a water inlet joint 12, and the water outlet is connected to a water outlet joint 13. In this embodiment, there are two water outlets, and the two water outlets are respectively connected to one of the water outlet joints 13. The switching assembly 4 is inserted and accommodated in the water passage cavity, and is interconnected with the water inlet joint 12. By operating the switching assembly 4, the water inlet joint 12 may be selectively connected to one of the two water outlets. A movement channel 114 is arranged between the insertion channel and the water passage cavity. The water outlet pipe assembly 3 is inserted through the insertion channel. The movement channel 114 is internally provided with a piston 2, and the piston 2 is movable in the movement channel 114 and can press against the water outlet pipe assembly 3. The water inside the water passage cavity applies pressure on the piston 2 to push the piston and make the piston press against the water outlet pipe assembly 3, thereby providing an additional means to help in avoiding movement of the water outlet pipe assembly 3 and ensuring that the water outlet pipe assembly 3 is stably fastened. Especially during the process of taking a shower, the present disclosure can ensure that the water outlet pipe assembly 3 will not suddenly fall down and hurt the user.

Figure 4:
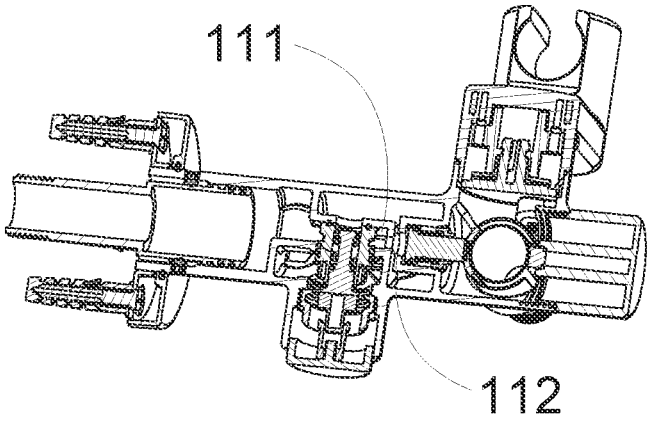
FIG. 4 is a second sectional view of the anti-slip shower system of the present disclosure.

The water passage cavity is internally provided with partition walls to divide the water passage cavity into a water inlet cavity, an accommodation cavity 111, and two water outlet cavities 113 that are spaced apart. The water inlet cavity, the accommodation cavity 111 and the water outlet cavities 113 are interconnected sequentially. One of the water outlet cavities 113 is interconnected with the water outlet pipe assembly 3, and the other water outlet cavity 113 is connected to the handheld shower via the water outlet joint 13. The accommodation cavity 111 is provided with a through opening at a side away from the water inlet cavity. The switching assembly 4 is inserted into and accommodated in the accommodation cavity 111 from the opening, and the switching assembly 4 can be operated to select one of the water outlet cavities 113 to interconnect with the water inlet cavity. The movement channel 114 is provided with a water passage hole 112 at a side close to the water passage cavity. The water passage hole 112 is interconnected with the accommodation cavity 111 and/or the water outlet cavity 113. The water flows from the water passage cavity to the movement channel 114 via the water passage hole 112, and pushes the piston 2 to press against the water outlet pipe assembly 3, so that the water outlet pipe assembly 3 is stably fastened and unlikely to move and fall down. In this embodiment, the water passage hole 112 is interconnected with the accommodation cavity 111, so that the water can flow directly from the accommodation cavity 111 to the movement channel 114 to push the piston 2. Referring to FIG. 4, the switching assembly is operated to switch the water passage and connect the water flow in the water passage cavity to the handheld shower. In another embodiment, the water passage hole 112 is interconnected with the water outlet cavity 113, and the switching assembly 4 is operated to switch the water passage and connect the water flow to the water outlet cavity 113 interconnected with the water outlet pipe assembly 3, so that the water flows to the water outlet pipe assembly 3 to be discharged.

Figure 6:
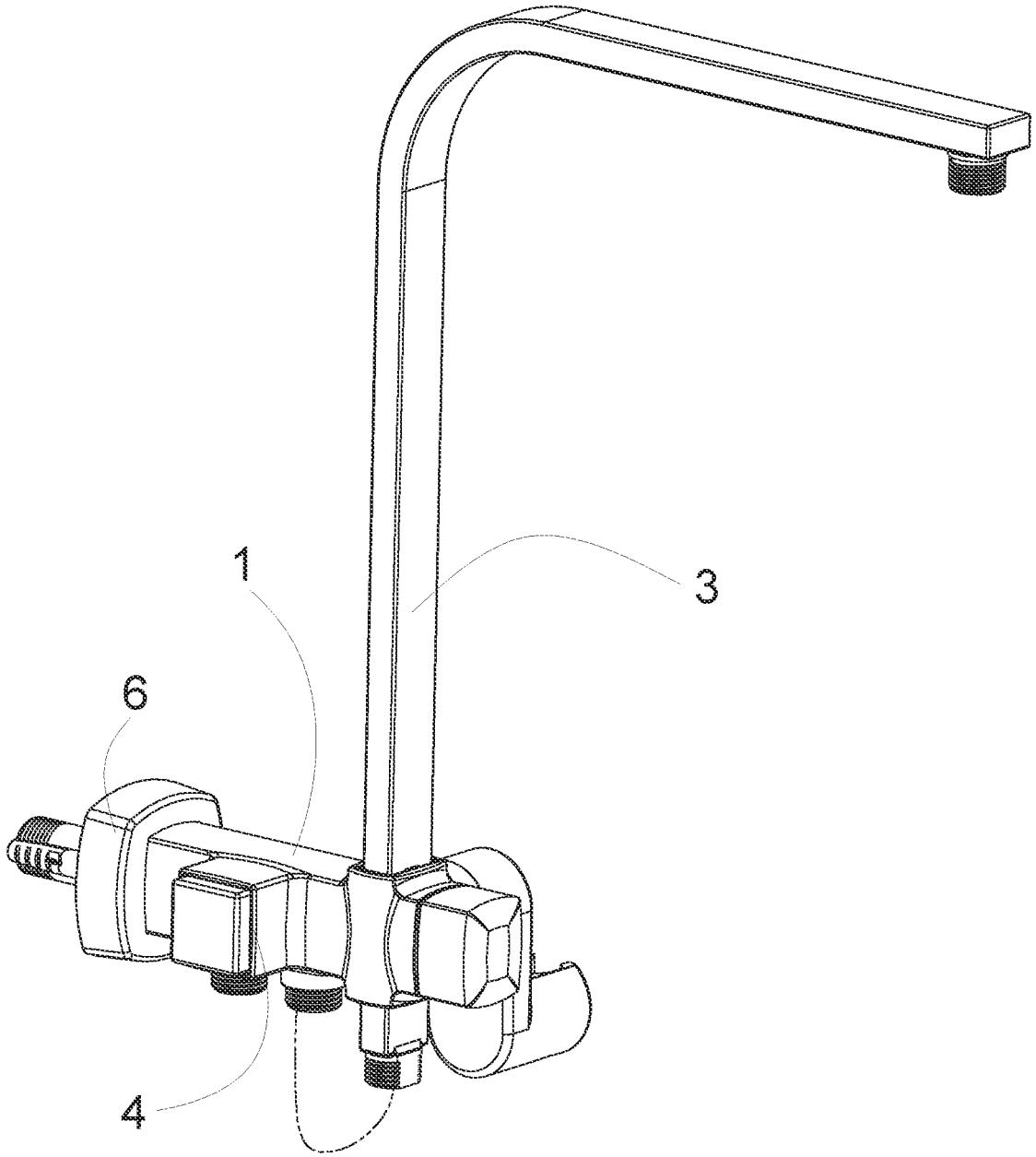
FIG. 6 is an axonometric view of an anti-slip shower system according to another embodiment of the present disclosure.
Figure 7:
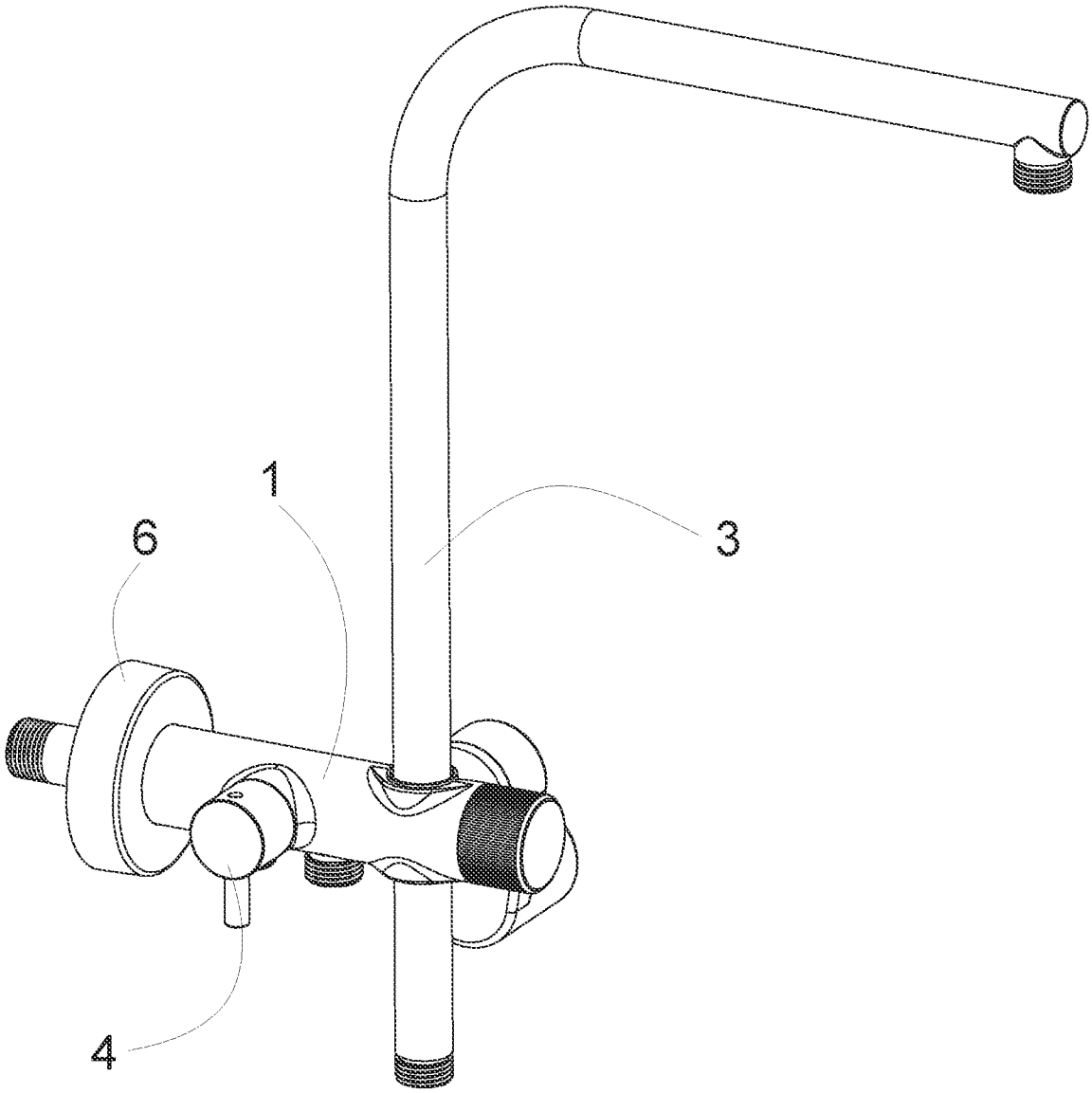
FIG. 7 is an axonometric view of an anti-slip shower system according to yet another embodiment of the present disclosure.

The switching assembly 4 includes a switching cartridge 41, a fastening cover 42 placed on the switching cartridge 41, and an operation element 43 sleeved on the switching cartridge 41. The switching cartridge 41 is inserted into the accommodation cavity 111. The accommodation cavity 111 is provided with a connection part at a side away from the water inlet cavity, and the fastening cover 42 tightly presses against the switching cartridge 41 and is connected with the connection part. The operation element 43 is movably inserted into the opening and is connected with the switching cartridge 41 to switch the switching cartridge 41 to select and connect one of the water outlet cavities 113. Referring to FIGS. 1-6, the operation element 43 is configured as a button, and accordingly the switching cartridge 41 is a press-type switching cartridge 41. Referring to FIG. 7, the operation element 43 is configured as a knob, and accordingly the switching cartridge 41 is a rotary switching cartridge 41.

The insertion channel is provided with an opening at a side away from the water passage cavity, and the inner wall of the opening is provided with an adjustment female part. The water outlet pipe assembly 3 includes an anti-slip component 31 configured inside the insertion channel, a supportive pipe 32 movably inserted in the anti-slip component 31, and the adjustment male part 33 movably inserted in the opening. The adjustment male part 33 is movably connected with the adjustment female part. The adjustment male part 33 is provided with a pushing position at a side close to the anti-slip component 31. The anti-slip component 31 has a through cavity that runs through the upper and lower ends, and two avoidance holes arranged on the sidewall. The two avoidance holes are spaced apart. The avoidance hole located at a side close to the adjustment male part 33 is provided with a convex pushing part corresponding to the push position. The pushing part is provided with a protrusion at a side facing the adjustment male part 33, and the protrusion presses against the pushing position. The surface of the inner wall of the pushing part is provided with fastening walls extending inward, and two sides of the inner wall of the avoidance hole located at a side away from the adjustment male part 33 are provided with convex fastening walls. The supportive pipe 32 is inserted through the through cavity and presses the pushing part outward, and the supportive pipe 32 can move up and down in the through cavity. When the adjustment male part 33 is fastening on the adjustment female part, the adjustment male part 33 approaches the supportive pipe 32 until the protrusion presses against the pushing position, and the pushing part moves toward the supportive pipe 32 to tightly press against the supportive pipe 32.

The avoidance hole at a side away from the adjustment male part 33 corresponds to the piston 2. The piston 2 includes a piston main body 21 connected to the movement channel 114 and a movable fastening element 22 movably inserted in the piston main body 21. The movable fastening element 22 can movably press against the supportive pipe 32, so as to secure the supportive pipe 32 and avoid movement. The piston main body 21 has a recess and a through hole extending through the recess. The movable fastening element 22 includes a push rod and a restriction part provided on the push rod at an end away from the piston main body 21. An outer circumferential wall of the restriction part is provided with a sealing groove which is concave inward. A sealing ring is arranged in the sealing groove to sealingly connect the sidewall of the movable fastening element 22 and the movement channel 114. A spring 23 is sleeved on the push rod, and the spring 23 is limited between the restriction part and the recess. When the water flows into the movement channel 114 from the water passage hole 112, under the action of water pressure, the movable fastening element 22 is pushed to move toward the supportive pipe 32 and then to tightly press against the supportive pipe 32. When water stops flowing into the movement channel 114, no water pressure is applied on the movable fastening element 22, and the movable fastening element 22 moves away from the supportive pipe 32 under the action of the spring 23, such that the supportive pipe 32 is released to be able to move up and down.

One end of the water passage assembly 1 away from the water outlet pipe assembly 3 is connected with installation accessories 6, and a decorative cover 5 is sleeved on the water passage assembly 1. The installation accessories 6 are screwed and secured on the wall body to mount the water passage assembly 1 on the wall. The installation accessories 6 include a plurality of sleeves 61 and screws 62 matched with the sleeves 61. Referring to FIG. 1 and FIG. 6, the appearance of the water passage assembly 1 and the water outlet pipe assembly 3 may be circular, square, a combination of circular and square, irregularly shaped, or a combination of various shapes. The water passage assembly 1 and the water outlet pipe assembly 3 of these shapes should all be considered as falling within the scope of protection of the present disclosure.

The working principle of the present disclosure is briefly described as follows.

The water flows into the water inlet cavity from the water inlet joint 12 and then flows to the accommodation cavity 111. By operating the switching assembly 4, the water passage may be selected and switched to connect the water flow to any of the water outlet cavities 113.

Figure 5:
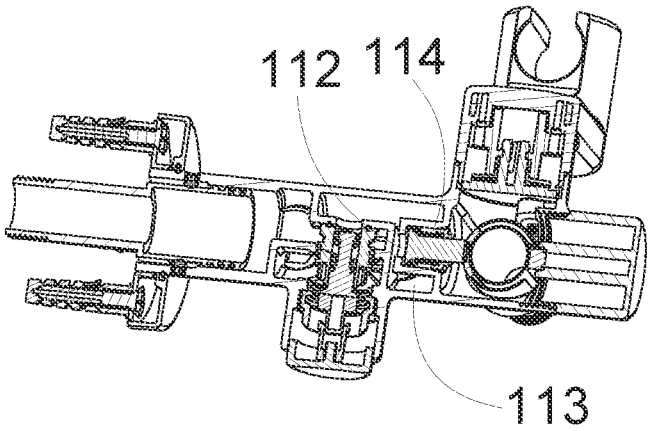
FIG. 5 is a third sectional view of the anti-slip shower system of the present disclosure.

When the switching assembly 4 is operated to connect the water flow to the water outlet cavity 113 interconnected with the water outlet pipe assembly 3, the water not only flows through the water outlet cavity 113, the water outlet joint 13, and the water outlet pipe assembly 3, but also flows through the water passage hole 112 to push the piston 2 as shown in FIG. 5. Under the action of the water pressure, the movable fastening element 22 of the piston 2 is pushed to move toward the water outlet pipe assembly 3, and the spring 23 is simultaneously compressed under the action of water pressure, such that it is ensured that the movable water outlet pipe assembly 3 is stably fixed during the process of taking a shower.

When the switching assembly 4 is operated to connect the water flow to the water outlet cavity 113 interconnected with the handheld shower, the water not only flows through the water outlet cavity 113, the water outlet joint 13, and the handheld shower, but also flows through the accommodation cavity 111 and the water passage hole 112 to push the piston 2 as shown in FIG. 4. Under the action of the water pressure, the movable fastening element 22 of the piston 2 is pushed to move toward the water outlet pipe assembly 3, and the spring 23 is simultaneously compressed under the action of water pressure, such that it is ensured that the movable water outlet pipe assembly 3 is stably fixed during the process of taking a shower.

When no water flows in the water outlet cavity 113 or the accommodation cavity 111, there is no water pressure applied on the piston 2, and the movable fastening element 22 moves toward the water passage hole 112 and gets away from the water outlet assembly 3 under the action of the reset force of the spring 23, such that the water outlet pipe assembly is released. Meanwhile, with the anti-slip component 31 and the adjustment male part 33, the water outlet pipe assembly 3 cannot move arbitrarily.

According to the present disclosure, a piston 2 is arranged between the water passage assembly 1 and the water outlet pipe assembly 3. Under the action of the water pressure from the water flow in the water passage assembly 1, the piston 2 is pushed to approach and then tightly press against the water outlet pipe assembly 3, so as to provide an additional securing structure to avoid movement of the water outlet pipe assembly in the process of taking a shower. The water passage assembly 1 is internally provided with a water passage cavity and an insertion channel, and the movable water outlet pipe assembly 3 is inserted through the insertion channel. A movement channel 114 is provided between the insertion channel and the water passage cavity, so that the piston 2 is movable in the movement channel 114 to press against or move away from the water outlet pipe assembly 3. When water flows through, the piston 2 is applied with water pressure to push against the water outlet pipe assembly 3. When there is no water flow, no water pressure is applied on the piston 2 and the piston 2 moves away from the water outlet pipe assembly 3, so as to allow adjustment of the height of the water outlet pipe assembly 3 as desired. The water passage cavity is provided with a water inlet cavity, an accommodation cavity 111 and a plurality of water outlet cavities 113 that are partitioned with each other and are interconnected in sequence. The water passage hole 112 arranged on the movement channel 114 is interconnected with the accommodation cavity 111 or the water outlet cavity 113. By doing so, after operating the switching assembly 4 in the accommodation cavity 111, no matter which water outlet cavity 113 the water flow is switched to, the pressure of the water flow can always be applied on the piston 2 to push the piston 2 to press against the water outlet pipe assembly 3. Therefore, either the top shower mounted on the water outlet pipe assembly 3 or the handheld shower is used by the user during the process of taking a shower, it can all be ensured that the movable water outlet pipe assembly 3 is stably fastened.

The foregoing description illustrates and describes preferred embodiments of the present disclosure. As previously stated, it should be understood that the present disclosure is not limited to the forms disclosed in the present disclosure, and the illustrated embodiments should not be construed as an exclusion of other embodiments. The illustrated embodiments may be incorporated in other combinations, or may be modified or applied in other environment or settings. Also, the illustrated embodiments may be modified according to the teachings or suggestions of the present disclosure or technology or knowledge from related fields within the scope of the inventive concept of the present disclosure. However, modifications and changes made by those skilled in the art without departing from the spirit and scope of the present disclosure should all be considered as falling within the scope of protection defined by the appended claims of the present disclosure.

What is claimed is:

1. An anti-slip shower system, comprising a water passage assembly and a water outlet pipe assembly movably arranged on the water passage assembly; wherein the water outlet pipe assembly includes an adjustment male part which can limit movement of the water outlet pipe assembly in height direction on the water passage assembly;

the water passage assembly includes a water passage cavity and an insertion channel, the water passage cavity and the insertion channel are arranged at an interval, and a movement channel is arranged between the insertion channel and the water passage cavity;

the movement channel is internally provided with a piston, the piston is configured to move toward the water outlet pipe assembly under water pressure and move away from the water outlet pipe assembly without water pressure, when the piston and the adjustment male part are away from the water outlet pipe assembly, the water outlet pipe assembly is movable in height direction on the water passage assembly, when the piston and/or the adjustment male part approaches to press against the water outlet pipe assembly, the water outlet pipe assembly is stably fixed.

2. The anti-slip shower system according to claim 1, wherein the water passage cavity is internally provided with partition walls to divide the water passage cavity into a water inlet cavity, an accommodation cavity and at least two water outlet cavities that are spaced apart, the water inlet cavity, the accommodation cavity and the water outlet cavities are interconnected sequentially;

the movement channel is provided with a water passage hole at a side close to the water passage cavity, and the water passage hole is interconnected with the accommodation cavity and/or the water outlet cavities.

3. The anti-slip shower system according to claim 2, wherein the water passage assembly comprises a main body;

the water passage cavity, the insertion channel, and the movement channel are all configured in the main body, and the main body has an water inlet and a plurality of water outlets, the water inlet and the water outlets are interconnected with the water passage cavity;

the water inlet is connected with a water inlet joint, and the water outlets are connected with water outlet joints respectively.

4. The anti-slip shower system according to claim 3, further comprising a switching assembly, wherein the switching assembly is inserted and accommodated in the water passage cavity, and the switching assembly is interconnected with the water inlet joint, by operating the switching assembly to select or switch water passage, the water inlet joint is selectively connected to the plurality of water outlets.

5. The anti-slip shower system according to claim 4, wherein the water inlet cavity is interconnected with the water inlet joint, and each of the water outlet cavities is connected to one of the water outlet joints, the accommodation cavity is provided with a through opening at a side away from the water inlet cavity, and the switching assembly is inserted into and accommodated in the accommodation cavity from the through opening.

6. The anti-slip shower system according to claim 3, wherein there are two water outlet cavities, one of the water outlet cavities is connected with the water outlet pipe assembly through a first water outlet joint, and the other one of the water outlet cavities is connected to a hand shower through a second water outlet joint.

7. The anti-slip shower system according to claim 1, wherein the insertion channel is provided with an opening at a side away from the water passage cavity, the opening is provided with an adjustment female part, and the adjustment male part is movably connected with the adjustment female part to press against or move away from the water outlet pipe assembly.

8. The anti-slip shower system according to claim 7, wherein the water outlet pipe assembly includes an anti-slip component arranged in the insertion channel and a supportive pipe movably inserted into the anti-slip component, the adjustment male part is inserted into the opening to fasten or release the supportive pipe by pressing against or moving away from the anti-slip component.

9. The anti-slip shower system according to claim 8, wherein the piston includes a piston main body connected to the movement channel and a movable fastening element movably inserted in the piston main body, the movable fastening element movably presses against the supportive pipe to suppress movement of the supportive pipe.

10. The anti-slip shower system according to claim 9, wherein the piston main body has a recess and a through hole extending through the recess;

the movable fastening element has a push rod and a restriction part, the restriction part is provided on the push rod at an end away from the piston main body;

an outer circumferential wall of the restriction part is provided with a sealing groove which is concave inward, a spring is sleeved on the push rod, and the spring is limited between the restriction part and the recess.

* * * * *